US008875313B2

(12) United States Patent
Ramirez

(10) Patent No.: US 8,875,313 B2
(45) Date of Patent: Nov. 4, 2014

(54) HOODED GARMENT WITH HIDDEN DRAWSTRING

(71) Applicant: Pedro Ramirez, Gilroy, CA (US)

(72) Inventor: Pedro Ramirez, Gilroy, CA (US)

( * ) Notice: Subject to any disclaimer, the term of this patent is extended or adjusted under 35 U.S.C. 154(b) by 0 days.

(21) Appl. No.: 14/060,291

(22) Filed: Oct. 22, 2013

(65) Prior Publication Data

US 2014/0109287 A1 Apr. 24, 2014

Related U.S. Application Data

(60) Provisional application No. 61/716,851, filed on Oct. 22, 2012.

(51) Int. Cl.

| | |
|---|---|
| ***A41D 3/08*** | (2006.01) |
| ***A42B 1/04*** | (2006.01) |
| ***A41D 3/02*** | (2006.01) |
| ***A41D 3/00*** | (2006.01) |
| *A41F 1/00* | (2006.01) |

(52) U.S. Cl.

CPC . *A41D 3/02* (2013.01); *A42B 1/048* (2013.01); *A41F 1/00* (2013.01); *A41D 2200/20* (2013.01); *A41D 2300/33* (2013.01); *A42B 1/04* (2013.01); *A41D 3/005* (2013.01)

USPC ..... 2/84

(58) Field of Classification Search

USPC ..... 2/84, 85, 86, 69, 88, 93, 94, 95, 97, 2/108, 115, 202

See application file for complete search history.

(56) References Cited

U.S. PATENT DOCUMENTS

| | | | | |
|---|---|---|---|---|
| 3,711,865 | A * | 1/1973 | Schifman | 2/79 |
| 6,370,692 | B1 * | 4/2002 | Duyn et al. | 2/86 |
| 6,564,388 | B1 * | 5/2003 | Poston | 2/86 |
| 7,387,272 | B2 * | 6/2008 | Okot | 242/395.1 |
| 7,418,740 | B2 * | 9/2008 | Anderson et al. | 2/69 |
| 7,519,192 | B1 * | 4/2009 | Laycock et al. | 381/301 |
| 7,921,471 | B2 * | 4/2011 | Mordecai et al. | 2/98 |
| 8,201,273 | B2 * | 6/2012 | Duncan | 2/202 |

* cited by examiner

*Primary Examiner* — Tejash Patel

(74) *Attorney, Agent, or Firm* — Berenato & White, LLC

(57) ABSTRACT

A hooded garment comprises a torso portion, a hood portion attached to the torso portion and provided with a frontal face opening having a peripheral edge and a hood channel extending around at least a greater part of the peripheral edge, and a flexible drawstring extending through the hood channel. The drawstring is provided to adjust the effective perimeter of the peripheral edge of the face opening. The drawstring includes a middle portion slidably disposed in the hood channel, a first side portion extending from one side of the hood channel and a second side portion extending from another side of the hood channel. The first and second side portions are disposed outside the hood channel in the hood portion so that a greater part of each of the first and second side portions is hidden within or behind the torso portion.

10 Claims, 6 Drawing Sheets

HOODED GARMENT WITH HIDDEN DRAWSTRING

CROSS-REFERENCE TO RELATED APPLICATION

This Application claims the benefit under 35 U.S.C. 119(e) of U.S. Provisional Patent Application Ser. No. 61/716,851 filed Oct. 22, 2012 by Ramirez, P., which is hereby incorporated herein by reference in its entirety and to which priority is claimed.

BACKGROUNDS OF THE INVENTION

1. Field of the Invention

The present invention relates to garment in general and, more particularly, to an outerwear, such as a jacket, vest, coat, sweatshirt and the like, with an integral or removable hood for covering a wearer's head.

2. Description of the Related Art

Over the past few decades, hooded garments have become immensely popular throughout the world due largely to their inexpensive and durable fabrication, structural simplicity, low maintenance, versatility and fashion adaptability. Hardly a household exists anywhere in the United States without at least one hooded garment, particularly garments more popularly referred to as hoodies. The most common hooded garments include hood closing elements typically referred to as drawstrings. Drawstring elements usually comprise linearly woven textile material with terminal ends knotted to avoid unraveling, and often provided with aglets (plastic or metal tips) to prevent unraveling and enable threading.

Drawstrings (also called cords, ropes or strings) are usually added subsequent to fabrication of the basic garment. For example, a hood drawstring can be threaded through a fabric tunnel known as a drawstring channel or hemmed casing. The drawstring is pulled to cinch, gather or close the hood covering about a wearer's head. Tension on the drawstring draws the head covering more tightly, particularly immediately adjacent to the wearer's (exposed) face. The drawstring is positioned to substantially surround a forwardly projected peripheral edge of the hood opening (accommodating the wearer's face). The drawstring passes through the channel adjacent the wearer's head crown and terminates therebelow with a pair of dangling or suspended ends. Drawstring ends may terminate just outside the wearer's neckline or extend downwardly for a relatively short distance along the garment outer chest surface. While readily accessible and operable, such openly exposed drawstrings have recently resulted in millions of such garments being pulled from the marketplace.

In 1996 the United States Consumer Product Safety Commission (CPSC) completed a review of child strangulations resulting from children becoming entangled on drawstrings of upper outerwear garments. The Commission declared such drawstrings a hidden hazard that can lead to deaths and injuries and issued guidelines for drawstrings on children's upper outerwear to help prevent children from strangling or becoming entangled on the neck and waist drawstrings of upper outerwear garments, such as jackets and sweatshirts. Subsequently, CPSC issued warning letters to manufacturers, retailers, and importers of children's upper outwear garments, urging them to make certain the garments do not have hood drawstrings that can pose a strangulation hazard, and a number of recalls ensued.

More recently the Commission revisited and toughened its stance, declaring the drawstring construct to be a substantial product hazard, especially for children. Last year, the fashion industry was faced with CPSC's issuance of formal Federal regulations followed by substantial fines to a significant number of retailers and manufacturers.

As an outcome of the standards imposed by Federal regulation along with aggressive enforcement measures, the marketplace has seen marked changes in garment hood closure construction. One result is that previously convenient and easily manipulated drawstrings are being replaced with snaps, VELCRO® hook and loop fasteners, buttons and elastic bands. In certain designer wear the consumer increasingly sees metal slide locks directly attached to hood tightening tendons adjacent the front and back of a garment hood. These changes have added to garment construction and maintenance costs, complicated the casual hood closure operation, and more than subtly altered the popular and fashionable look of what had become a wardrobe staple.

The need, thus, exists for a simple, yet elegant solution to this problem.

SUMMARY OF THE INVENTION

The present invention is directed to a hooded garment for a person. The hooded garment of the present invention comprises a torso portion, a hood portion attached to the torso portion and provided with a frontal face opening therein, and a flexible drawstring. The hood portion has a peripheral edge around the face opening and a hood channel extending around at least a greater part of the peripheral edge. The flexible drawstring is provided to adjust the effective perimeter of the peripheral edge of the face opening of the hood portion defining a size of the face opening. The flexible drawstring is slidably extending through the hood channel. The drawstring includes a middle portion slidably disposed in the hood channel, a first side portion extending from one side of the hood channel and a second side portion extending from another side of the hood channel. The first and second side portions are disposed outside the hood channel in the hood portion so that a greater part of each of the first and second side portions is hidden within or behind the torso portion.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, wherein.

DETAILED DESCRIPTION OF EXEMPLARY EMBODIMENTS

Figure 1:
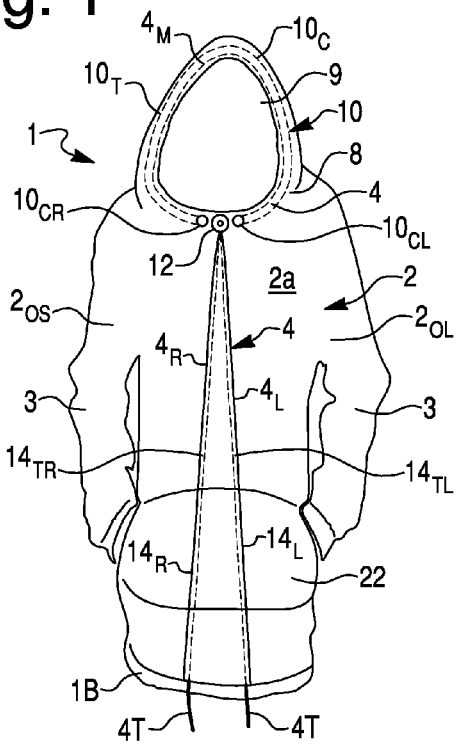
FIG. 1 is a front elevation view of a hooded garment including a drawstring arrangement according to a first exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "left," "right," "top" and "bottom" as well as derivatives thereof (e.g., "horizontally," "leftward," "rightward," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one".

A hooded garment is a garment or an article of clothing, especially a hooded outerwear, such as a jacket, vest, coat, sweater, sweatshirt and the like, that continuously covers an upper torso of a wearer and selectively covers a head thereof on all sides but a face. A portion covering the head of a wearer is commonly referred to as a hood.

Figure 2:
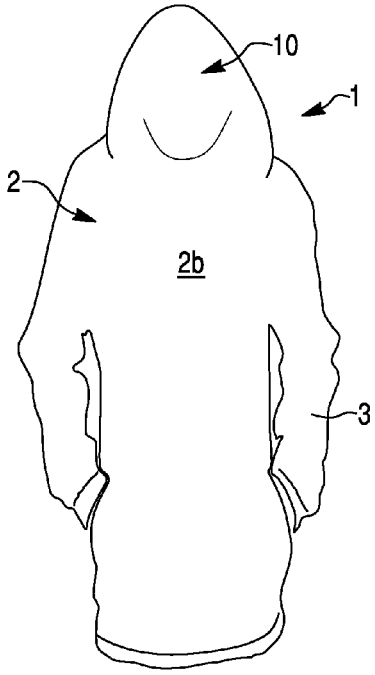
FIG. 2 is a rear elevation view of the hooded garment of FIG. 1.

FIGS. 1 and 2 of the drawings illustrate a hooded garment, such as a hooded outerwear for a person (or wearer), with an integral or removable hood for covering most of a wearer's head and neck, according to a first exemplary embodiment of the present invention, indicated generally by reference numeral 1. The hooded outerwear 1 comprises a torso portion 2 with integral arm portions 3, and a hood portion 10 in the form of a hood integrally or removably attached to the torso portion 2. The torso portion 2 of the hooded outerwear 1 is provided with an outer layer including a front body portion 2*a* and a back body portion 2*b*. The torso portion 2 of the hooded garment 1 has an outer surface $\mathbf{2}_{OS}$ and an inner surface.

Figure 3:
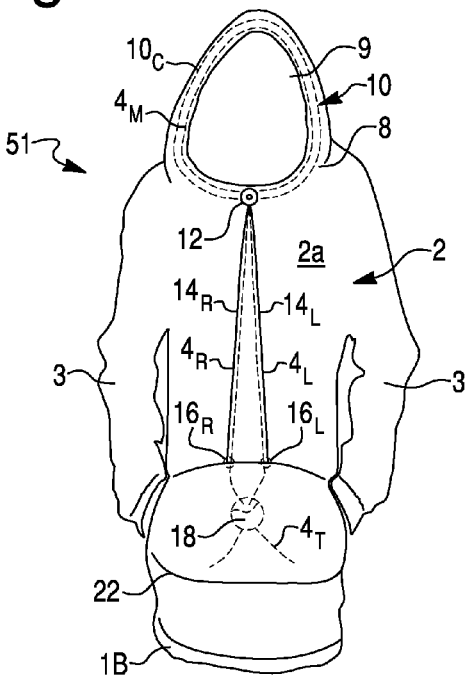
FIG. 3 is a front elevation view of a hooded garment according to a second exemplary embodiment of the present invention.

The hood portion 10 is further provided with a frontal face opening 9 therein. The hood portion 10 has a peripheral edge 9*a* around the face opening 9. The hood portion 10 of the hooded outerwear 1 further comprises a tunnel-like hood drawstring casing $\mathbf{10}_T$ about the face opening 9 defining an enclosed hood drawstring channel $\mathbf{10}_C$ extending around at least a greater part of the peripheral edge 9*a*. The hood drawstring channel $\mathbf{10}_C$ has right and left exit holes $\mathbf{10}_{CR}$ and $\mathbf{10}_{CL}$ near a neckline 8 of the hooded outerwear 1. Alternatively, the hood drawstring channel $\mathbf{10}_C$ has a single exit hole $\mathbf{10}_{CX}$, as illustrated in FIG. 3. The exit holes may include plastic or metal grommet elements to avoid excessive fabric wear.

The hooded outerwear 1 also comprises a flexible drawstring 4 (cord, rope, line and the like) provided to adjust the effective perimeter of the peripheral edge 9*a* of the face opening 9 of the hood portion 10 defining a size of the face opening 9. The flexible drawstring 4 slidably extends through the hood drawstring channel $\mathbf{10}_C$. In other words, the drawstring 4 is threaded through the hood drawstring channel $\mathbf{10}_C$. The drawstring 4 includes a middle portion $\mathbf{4}_M$ slidably disposed in the hood channel $\mathbf{10}_C$, a right (or first) side portion $\mathbf{4}_R$ extending from one side of the hood channel $\mathbf{10}_C$ through the right exit hole $\mathbf{10}_{CR}$, and a left (or second) side portion $\mathbf{4}_L$ extending from another side of the hood channel $\mathbf{10}_C$ through the left exit hole $\mathbf{10}_{CL}$. Alternatively, if the hood drawstring channel $\mathbf{10}_C$ has a single exit hole $\mathbf{10}_{CX}$, both the right and left side portions $\mathbf{4}_R$, $\mathbf{4}_L$ extend from the hood channel $\mathbf{10}_C$ through the single exit hole $\mathbf{10}_{CX}$, as illustrated in FIG. 3. In other words, both the right and left side portions $\mathbf{4}_R$ and $\mathbf{4}_L$, respectively, are disposed outside the hood drawstring channel $\mathbf{10}_C$. Moreover, the drawstring 4 has right (or first) and left (or second) termini (or distal ends) $\mathbf{4}_{TR}$ and $\mathbf{4}_{TL}$, respectively. Thus, the right side portion $\mathbf{4}_R$ has the right terminus $\mathbf{4}_{TR}$, while the second side portion $\mathbf{4}_L$ has the left terminus $\mathbf{4}_{TL}$. The right side portion $\mathbf{4}_R$ and the second side portion $\mathbf{4}_L$ of the drawstring 4 are generally equal in length.

The right and left distal ends $\mathbf{4}_{TR}$ and $\mathbf{4}_{TL}$ are substantially structurally identical in the exemplary embodiments of the present invention. In view of the structural similarities thereof, and in the interest of simplicity, the following discussion will sometimes use a reference numeral in brackets without a last subscript letter to designate both of the substantially identical distal ends $\mathbf{4}_{TR}$ and $\mathbf{4}_{TL}$. Specifically, the reference numeral [$4_T$] will be used when generically referring to the right and left distal ends $4_{TR}$ and $4_{TL}$ rather than reciting all reference characters.

Each of the right and left side portions $4_R$ and $4_L$ of the drawstring 4 is typically knotted at the distal end [$4_T$] thereof to avoid drawstring unraveling. Alternatively, each of the distal ends [$4_T$] may be provided with a terminal aglet to aid threading of the drawstring 4 through the hood drawstring channel $10_C$, as well as to prevent unraveling.

The drawstring 4 is arranged within the hood drawstring channel $10_C$ so as to permit the right and left side portions $4_R$ and $4_L$ of the drawstring 4 to suspend downwardly from the hood portion 10 (guided by the hood drawstring channel $10_C$ of the hood drawstring casing $10_T$). According to the present invention, as illustrated in FIGS. 1 and 2, the right and left side portions $4_R$ and $4_L$ of the drawstring 9 are disposed outside the hood channel $10_C$ in the hood portion 10 so that a greater part of each of the first and second side portions $4_R$ and $4_L$ is disposed behind or within the front body portion 2*a* of the outer layer of the torso portion 2 of the hooded outerwear 1, in other words, behind an outer layer $2_{OL}$ of the torso portion 2. As a consequence, as a greater part of each of the first and second side portions is hidden within the torso portion 2, there are no dangling drawstring side portions $4_R$, $4_L$ over the visible front body portion 2*a* of the hooded outerwear 1.

As further illustrated in FIG. 1, the terminus [$4_T$] of each of the right and left side portions $4_R$ and $4_L$ of the drawstring 4 extends to an ending at around a bottom edge 1B of the hooded outerwear 1, where the drawstring 4 may be tied or locked in place once the hood portion 10 is closed at the face opening 9. The result is a hooded outerwear that does not include dangling drawstring side portions $4_R$, $4_L$ as safety hazards or as unstylish clutter. The effect is that the visible front body portion 2*a* of the hooded outerwear 1 is as clean in appearance as the back (rearward facing) body portion 2*b* of the hooded outerwear 1 depicted in FIG. 2.

As further illustrated in FIG. 1, the middle of the drawstring 4 rests near an apex of the hood portion 10, and the two generally equal side portions $4_R$, $4_L$ of the drawstring 4 follow along in both directions. From the apex of the hood portion 10, following each sides of the face opening 9, the drawstring 4 continues through the enclosed hood drawstring channel $10_C$ (confined within a fabric hem or hood drawstring casing $10_T$) along the edge of the face opening 9 of the hood portion 10 until it reaches a single upper guide ring 12 near the neckline 8 of the hooded outerwear 1 where the two suspended side portions $4_R$, $4_L$ of the drawstring 4 come together. Unlike the current hooded sweatshirt system, both suspended side portions $4_R$, $4_L$ of the drawstring 4 pass through the upper guide ring 12 directing the joined drawstring side portions $4_R$, $4_L$ into an interior of the torso portion 2 of the hooded outerwear 1. The upper guide ring 12 may include a plastic or metal grommet element to avoid excessive fabric wear.

Figure 22:
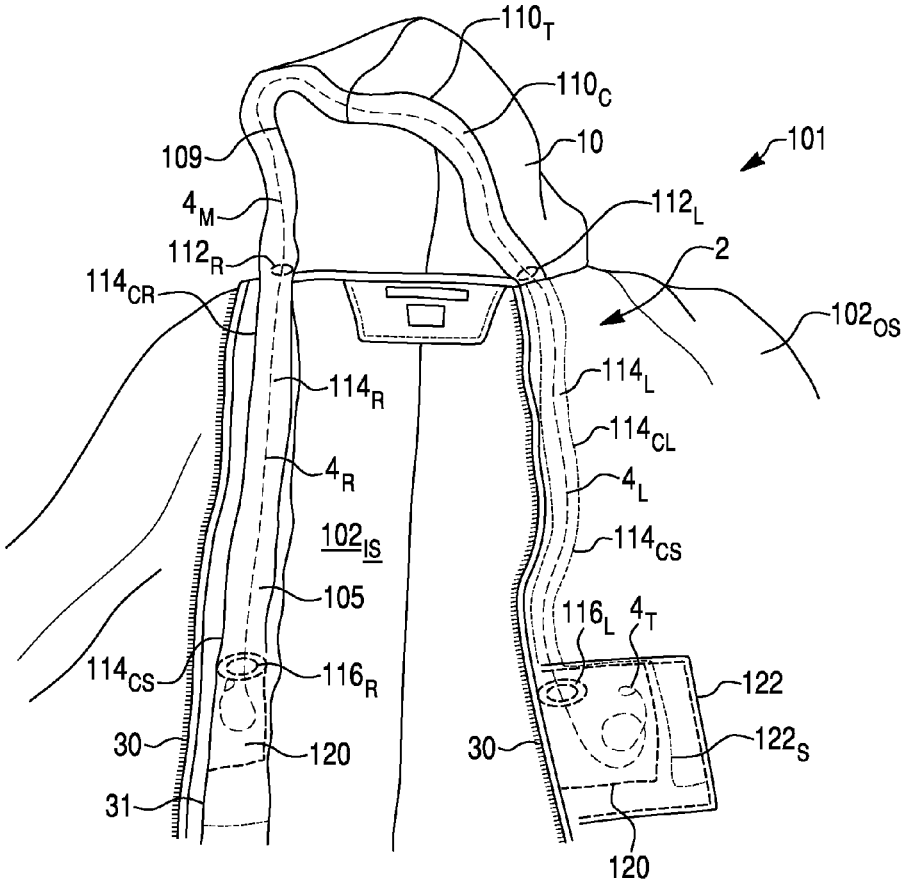
FIG. 22 is a front perspective view of a zippered hooded garment configured with hood closure drawstring elements in accordance with a sixth exemplary embodiment of the present invention.

At this point (i.e., from the upper guide ring 12), the two drawstring side portions $4_R$, $4_L$ enter separate torso drawstring channels $14_R$ and $14_L$ that follow along the interior of the outerwear 1 behind the outer layer $2_{OL}$ of the front body portion 2*a* of the torso portion 2. This can be done in a number of ways. First, if the outerwear 1 is lined, a lining and the outer layer $2_{OL}$ of the torso portion 2 are sewn or joined to create a pair of the torso drawstring channels $14_R$ and $14_L$ defined by right and left torso drawstring casings $14_{TR}$ and $14_{TL}$, respectively. If the outerwear 1 is not lined, a piece of cloth or other material, generally depicted with the reference numeral 105 in FIG. 22, is sewn (or otherwise affixed) into the interior of the outerwear 1 to create the torso drawstring channels $14_R$ and $14_L$ for each of the drawstring side portions $4_R$, $4_L$. From the point where both the right and left side portions $4_R$, $4_L$ of the drawstring 4 come together in the upper guide ring 12 at the neckline 8 of the outerwear 1, the torso drawstring channels $14_R$ and $14_L$ may be angled so that there is a distance between the right and left exit holes $10_{CR}$ and $10_{CL}$ approximately 2 to 6 inches apart. This distance is subject to change proportionally as the size of the outerwear 1 changes. Each of the right and left distal ends $4_{TR}$ and $4_{TL}$ exits its own individual hole. The exact location of the exit holes $10_{CR}$ and $10_{CL}$ is, of course, subject to change. The drawstring 4 can be tied off by a knot at the termini [$4_T$] thereof, or otherwise locked to prevent the distal ends [$4_T$] of the drawstring 4 from reentering the torso drawstring channels $14_R$ and $14_L$.

Figure 4:
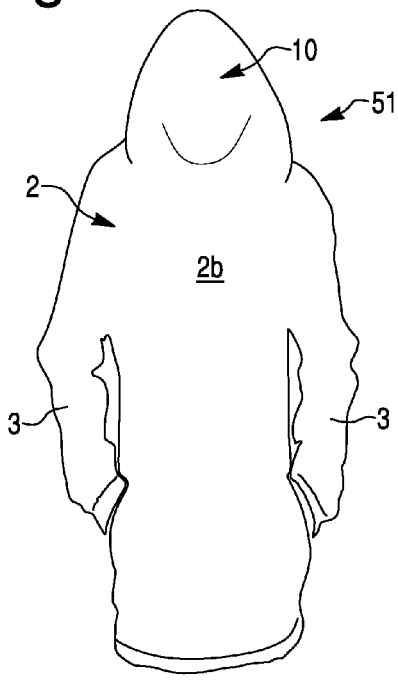
FIG. 4 is a rear elevation view of the hooded garment of FIG. 3.

FIGS. 3 and 4 illustrate a second exemplary embodiment of a hooded garment (or outerwear) of the present invention, generally depicted by the reference character 51. Components, which are unchanged from the first exemplary embodiment of the present invention, are labeled with the same reference characters. Components, which function in the same way as in the first exemplary embodiment of the present invention depicted in FIGS. 1 and 2 are designated by the same reference numerals to some of which number 50 has been added, sometimes without being described in detail since similarities between the corresponding parts in the two embodiments will be readily perceived by the reader.

The hooded garment 51 according to the second exemplary embodiment of the present invention, illustrated in FIG. 3, is similar to the hooded garment 1 shown in FIG. 1, and includes the drawstring 4 having the side portions $4_R$, $4_L$ downwardly extending behind the front body portion 2*a* of the torso portion 2. The main difference of the hooded garment 51 of the second exemplary embodiment of FIGS. 3, 4 with respect to the hooded garment 1 of the first exemplary embodiment of FIGS. 1, 2 lies in that each of the torso drawstring channels $14_R$ and $14_L$ is provided with a lower guide ring ($16_R$ and $16_L$, respectively) at the distal end thereof and a pocket muff 22. The lower guide rings $16_R$ and $16_L$ may include plastic or metal grommet elements to avoid excessive fabric wear. In the second exemplary embodiment, the side portions $4_R$, $4_L$ of the drawstring 4 exit from the interior of hooded garment 101 through an upper guide ring 12 (depicted and described above) or other defined passage opening, and exit through the lower guide rings $16_R$ and $16_L$ (or other defined passage openings) at the distal ends thereof directly into the pocket muff 22 where it can be manipulated, tied, locked etc. within the pocket muff 22. Again, the result is a sleek visible outer layer $2_{OL}$ of the front body portion 2*a* unencumbered by hazardously and cluttered drawstring exposure, again presenting the front body portion 2*a* clean in appearance as a back body portion 2*b* of the hooded garment 51 depicted in FIG. 4.

Further in accordance with the second exemplary embodiment of the present invention, the hooded garment 51 includes a shiftable drawstring lock 18. The drawstring lock 18 is provided for clamping the side portions $4_R$, $4_L$ of the drawstring 4 in tight clamping engagement, and preventing relative movement thereof. Specifically, upon emergence through the lower guide rings $16_R$ and $16_L$ at, the drawstring side portions $4_R$, $4_L$ are captured by the drawstring lock 18. The drawstring lock 18 can be of any well known construction such as the friction interference ball element illustrated in FIG. 21, or pressure clip. Alternatively, side portions $4_R$, $4_L$ of the drawstring 4 can simply be tied in a releasable knot. Any of several known locking methods/devices can be employed to maintain the hood closure until purposefully released. As viewed in FIG. 15, each of the drawstring side portions $4_R$, $4_L$ typically is knotted at the terminus [$4_T$] thereof to avoid drawstring unraveling. Alternatively, each of the termini [$4_T$]

can be provided with a terminal aglet to aid threading of the drawstring 4 through the torso drawstring channels $\mathbf{14}_R$ and $\mathbf{14}_L$, as well as to prevent unraveling.

FIGS. 5-8 illustrate a third exemplary embodiment of a hooded garment (or outerwear) of the present invention, generally depicted by the reference character 61. Components, which are unchanged from the first exemplary embodiment of the present invention, are labeled with the same reference characters. Components, which function in the same way as in the first exemplary embodiment of the present invention depicted in FIGS. 1 and 2 are designated by the same reference numerals to some of which number 60 has been added, sometimes without being described in detail since similarities between the corresponding parts in the two embodiments will be readily perceived by the reader.

The hooded garment 61 according to the third exemplary embodiment of the present invention, illustrated in FIGS. 5-8, is similar to the hooded garment 1 shown in FIG. 1, and comprises the drawstring 4 having the side portions $\mathbf{4}_R$, $\mathbf{4}_L$ downwardly extending behind the front body portion 2*a* of the torso portion 2. The torso portion 2 of the hooded garment 61 according to the third exemplary embodiment of the present invention depicted in FIG. 5, further comprises a hidden pocket 20 and a pocket muff 22. The hidden pocket 20 is located at an area adjacent a bottom edge 1B of the hooded garment 61 (shown in FIG. 5). The pocket 20 is provided (as for example by stitching or otherwise affixed) for storage of the distal ends [$\mathbf{4}_T$] of the drawstring 4 when secured (tied, locked, and the like).

Figure 5:
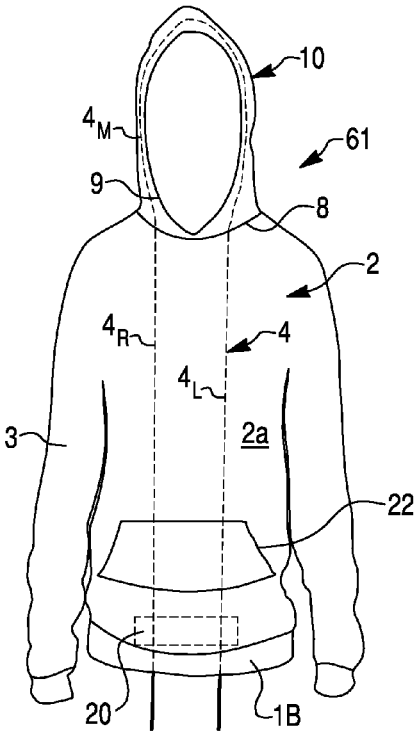
FIG. 5 is a front elevation view of a hooded garment according to a third exemplary embodiment of the present invention, illustrated with a hood in a raised position.
Figure 6:
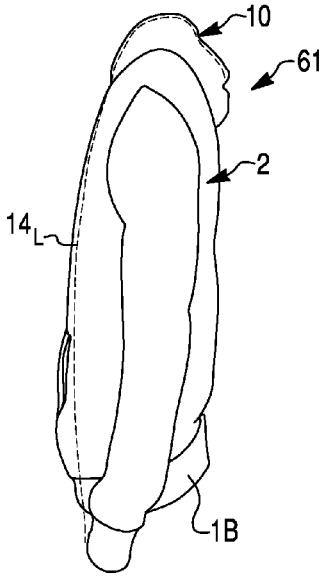
FIG. 6 is a side elevation view of the hooded garment of FIG. 5, illustrated with a hood in a lowered position.
Figure 7:
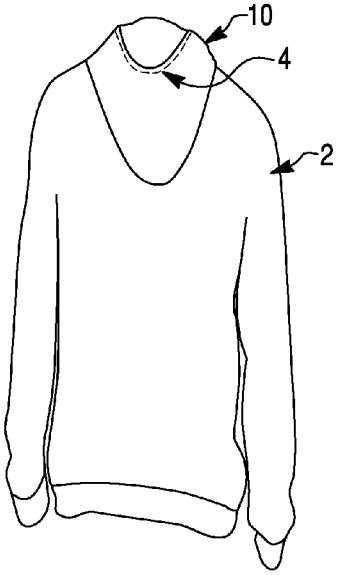
FIG. 7 is a rear elevation view of the hooded garment of FIG. 6.
Figure 8:
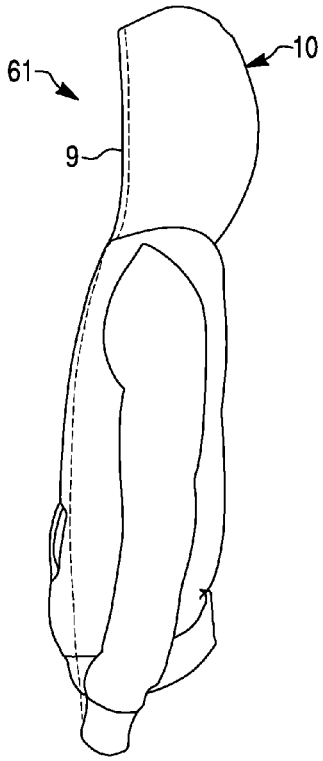
FIG. 8 is a side elevation view of the hooded garment of FIG. 5.
Figure 9:
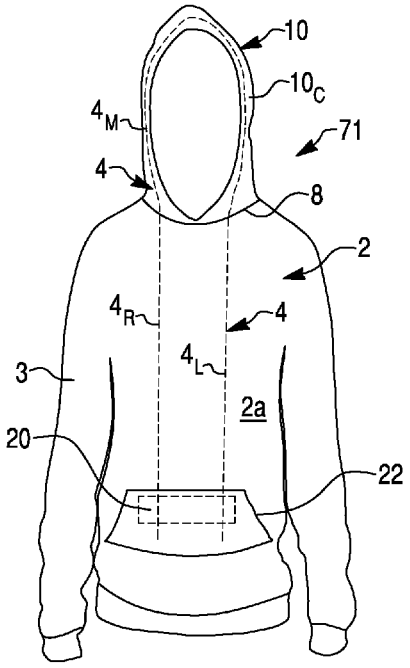
FIG. 9 is a front elevation view of a hooded garment according to a fourth exemplary embodiment of the present invention, illustrated with a hood in a raised position.

FIGS. 6-8 illustrate additional views of the hooded garment 61 according to the third exemplary embodiment of the present invention, with the hood portion 10 in raised and lowered positions. While the drawstring 4 (with side portions $\mathbf{4}_R$, $\mathbf{4}_L$) is depicted merely as a dashed line in FIGS. 5-8, it should be pointed out that the drawstring 4 is held in place and guided in its linear movement (closing and releasing the defined face opening 9 in the hood portion 10) within the hood drawstring channel $\mathbf{10}_C$ and the torso drawstring channels $\mathbf{14}_R$ and $\mathbf{14}_L$.

FIGS. 9-12 illustrate a fourth exemplary embodiment of a hooded garment (or outerwear) of the present invention, generally depicted by the reference character 71. Components, which are unchanged from the first exemplary embodiment of the present invention, are labeled with the same reference characters. Components, which function in the same way as in the first exemplary embodiment of the present invention depicted in FIGS. 1 and 2 are designated by the same reference numerals to some of which number 70 has been added, sometimes without being described in detail since similarities between the corresponding parts in the two embodiments will be readily perceived by the reader.

The hooded garment 71 according to the fourth exemplary embodiment of the present invention, illustrated in FIGS. 9-12, is similar to the hooded garment 71 shown in FIG. 5, and comprises the drawstring 4 having the side portions $\mathbf{4}_R$, $\mathbf{4}_L$ downwardly extending behind the front body portion 2*a* of the torso portion 2. The torso portion 2 of the hooded garment 61 according to the fourth exemplary embodiment of the present invention depicted in FIG. 9, also comprises a hidden pocket 20 and a pocket muff 22. The hidden pocket 20 is located within the pocket muff 22 (shown in FIG. 9). The pocket 20 is provided (as for example by stitching or otherwise affixed) for storage of the distal ends [$\mathbf{4}_T$] of the drawstring 4 when secured (tied, locked, and the like). In other words, the side portions $\mathbf{4}_R$, $\mathbf{4}_L$ of the drawstring 4 exit from the interior of hooded garment 71 directly into the pocket muff 22. Thus, the distal ends [$\mathbf{4}_T$] of the drawstring 4 can be manipulated, tied, locked etc. within the pocket muff 22.

Figure 10:
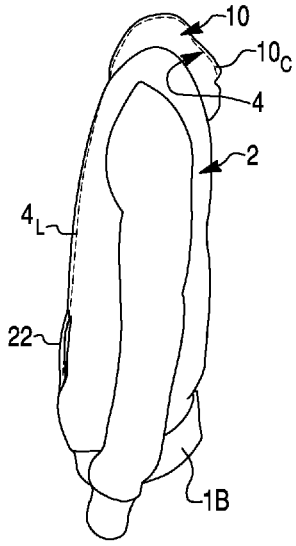
FIG. 10 is a side elevation view of the hooded garment of FIG. 9, illustrated with a hood in a lowered position.
Figure 11:
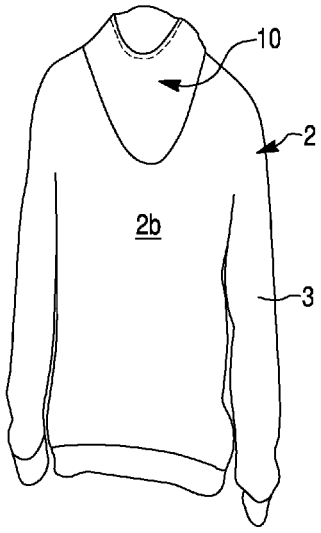
FIG. 11 is a rear elevation view of the hooded garment of FIG. 10.
Figure 12:
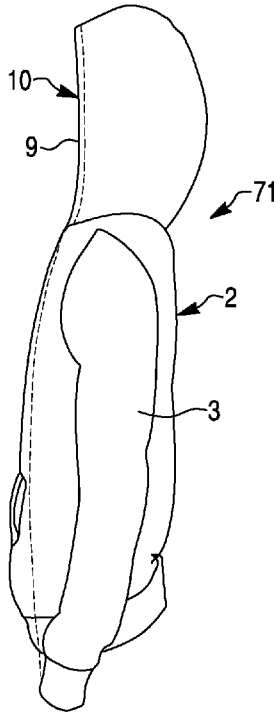
FIG. 12 is a side elevation view of the hooded garment of FIG. 9.

FIGS. 10-12 illustrate additional views of the hooded garment 71 according to the third exemplary embodiment of the present invention, with the hood portion 10 in raised and lowered positions. While the drawstring 4 (with side portions $\mathbf{4}_R$, $\mathbf{4}_L$) is depicted merely as a dashed line in FIGS. 9-12, it should be pointed out that the drawstring 4 is held in place and guided in its linear movement (closing and releasing the defined face opening 9 in the hood portion 10) within the hood drawstring channel $\mathbf{10}_C$ and the torso drawstring channels $\mathbf{14}_R$ and $\mathbf{14}_L$.

Figure 13:
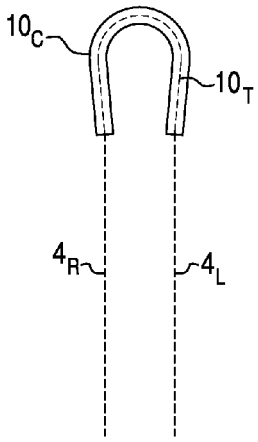
FIG. 13 shows a sweatshirt drawstring disposed within a hood drawstring casing adaptable to a garment hood portion, but without a casing about suspended end portions thereof.
Figure 14:
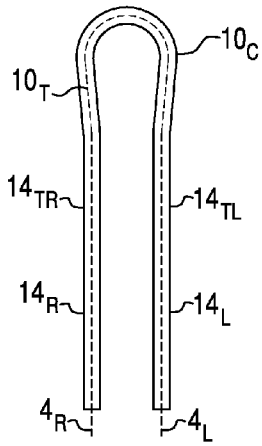
FIG. 14 shows a sweatshirt drawstring disposed within a hood drawstring casing adaptable to a garment hood portion and fully extended torso drawstring casings adaptable to a garment body portion.

The hooded garment according to the present invention may have only the hood drawstring casing of the hood drawstring channel $\mathbf{10}_C$ confined to the hood portion 10 only as shown in FIG. 13. Alternatively, the hooded garment according to the present invention may have both the hood drawstring casing of the hood drawstring channel $\mathbf{10}_C$ and the torso drawstring casings of the torso drawstring channels $\mathbf{14}_R$ and $\mathbf{14}_L$ run to any useful extent along the side portions $\mathbf{4}_R$, $\mathbf{4}_L$ of the drawstring 4 as illustrated in FIG. 14. In any case, the hood drawstring casing of the hood drawstring channel $\mathbf{10}_C$ can be fabricated as a stitched hem or separately applied tunnel casing, not generally visible from outside the hooded garment of the present invention.

Figure 15:
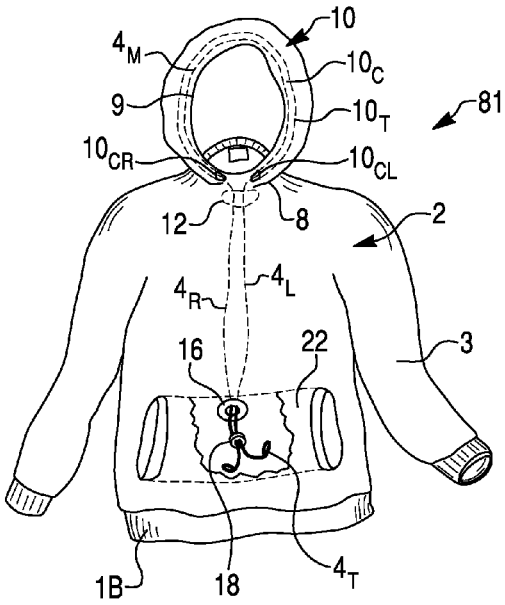
FIG. 15 is a front elevation view of a hooded garment according to a fifth exemplary embodiment of the present invention, illustrated with a hood portion in a raised position.
Figure 16:
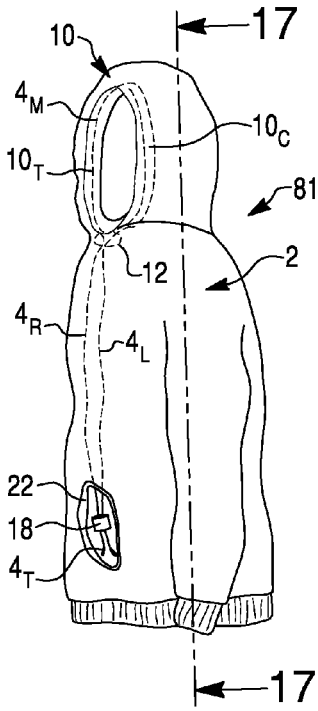
FIG. 16 is a side elevation of the hooded garment depicted in FIG. 15.
Figure 17:
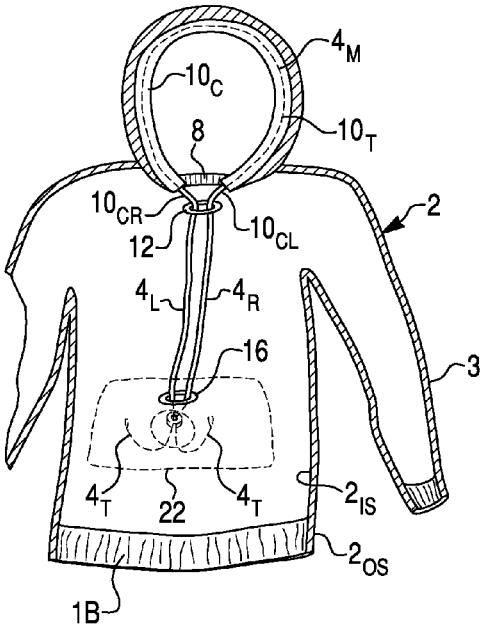
FIG. 17 is a cross-sectional view of the hooded garment according to the fifth exemplary embodiment of the present invention, taken along the line 17-17 in FIG. 16.

FIGS. 15-17 illustrate a fifth exemplary embodiment of a hooded garment (or outerwear) of the present invention, generally depicted by the reference character 81. Components, which are unchanged from the first exemplary embodiment of the present invention, are labeled with the same reference characters. Components, which function in the same way as in the first exemplary embodiment of the present invention depicted in FIGS. 1 and 2 are designated by the same reference numerals to some of which number 80 has been added, sometimes without being described in detail since similarities between the corresponding parts in the two embodiments will be readily perceived by the reader.

The hooded garment 81 according to the fifth exemplary embodiment of the present invention, illustrated in FIGS. 15-17, is similar to the hooded garment 1 shown in FIG. 1, and comprises the drawstring 4 having the side portions $\mathbf{4}_R$, $\mathbf{4}_L$ downwardly extending behind the front body portion 2*a* of the torso portion 2. The torso portion 2 of the hooded garment 81 according to the fifth exemplary embodiment of the present invention depicted in FIG. 15, further comprises a pocket muff 22.

Moreover, FIG. 15 shows a front elevation view of the hooded garment 81. FIG. 16 illustrates a side elevational view from which a section line 17-17 is taken so as to present cross-sectional view in FIG. 17 illustrating details of an inner front surface of the hooded garment 81. The torso portion 2 of the hooded garment 81 has an outer surface $\mathbf{2}_{OS}$ and an inner surface $\mathbf{2}_{IS}$. In the fifth exemplary embodiment of the present invention, a drawstring 4 is illustrated as confined and guided within the hood drawstring channel $\mathbf{10}_C$ of the hood portion 10. The hood drawstring channel $\mathbf{10}_C$ terminates at two ends $\mathbf{10}_{CR}$ and $\mathbf{10}_{CL}$ thereof adjacent a neck area 8, near an upper guide ring 12 positioned to redirect the drawstring 4 downwardly as depending or suspended side portions $\mathbf{4}_R$, $\mathbf{4}_L$ of the drawstring 4. The side portions $\mathbf{4}_R$, $\mathbf{4}_L$ of the drawstring 4 extend along the inner surface $\mathbf{2}_{IS}$ (or inner layer) of the torso portion 2 (as shown in FIG. 17) where they are guided into (i.e., inside) a pocket muff 22 via a single lower guide ring 16, well above a garment bottom 1B.

Upon emergence through lower guide ring 16 into the pocket muff 22 (bordered by pocket muff stitches $\mathbf{22}_S$), the side portions $\mathbf{4}_R$, $\mathbf{4}_L$ of the drawstring 4 are captured by a drawstring lock 18. The drawstring lock 18 can be of any well known construction such as the friction interference ball element illustrated, or pressure clip. Alternatively, the side portions $\mathbf{4}_R$, $\mathbf{4}_L$ of the drawstring 4 can simply be tied in a releasable knot. Any of several known locking methods/devices can be employed to maintain the hood closure until purposefully released. As shown in FIG. 15, each of the side portions $\mathbf{4}_R$, $\mathbf{4}_L$ of the drawstring 4 typically is knotted at its end to avoid drawstring unraveling. Alternatively, each of the termini [$\mathbf{4}_T$] of the side portions $\mathbf{4}_R$, $\mathbf{4}_L$ of the drawstring 4 can be provided with a terminal aglet to aid threading of the drawstring 4 through the hood drawstring channel $\mathbf{10}_C$ and the torso drawstring casings $\mathbf{14}_R$, $\mathbf{14}_L$, as well as to prevent unraveling.

Figure 18:
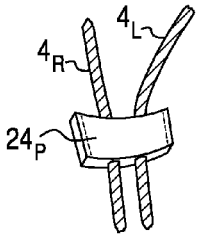
FIG. 18 shows a first embodiment of a drawstring guide element.
Figure 19:
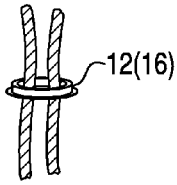
FIG. 19 shows a second embodiment of the drawstring guide element.
Figure 20:
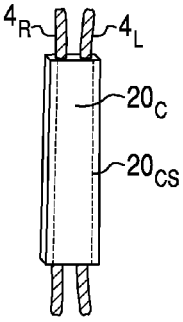
FIG. 20 shows a third embodiment of the drawstring guide element.
Figure 21:
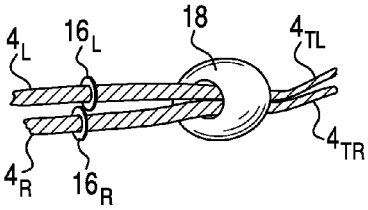
FIG. 21 shows a minor detail view of drawstrings (with guide elements and tip ancels) held in position by a drawstring lock.

The various alternative embodiments of the drawstring guide elements are shown in FIGS. 18-21. For example, FIG. 18 shows a stitched patch 24P that can be employed as an alternative to a guide ring or grommet (12 or 16), depicted in FIGS. 1, 3, 15, 17 and 19. FIG. 20 shows an extensive casing $\mathbf{20}_C$ with casing stitching $\mathbf{20}_{CS}$ defining a drawstring channel therewithin. In each of the embodiments of FIGS. 18-20, a single or double drawstring portions (e.g., $\mathbf{4}_R$, $\mathbf{14}_L$) can be guided and secured as necessary to proper performance. FIG. 21 shows a more detailed version of the drawstring side portions $\mathbf{4}_L$, $\mathbf{4}_R$ guidance by grommets 16 (or 12) with optional securement by the drawstring lock 18. Note the termini [$\mathbf{4}_T$] of the side portions $\mathbf{4}_R$, $\mathbf{4}_L$ of the drawstring 4, which can be advantageously used where knots or other terminal knobs may prove hazardous under CPSC guidelines.

FIG. 22 illustrates a sixth exemplary embodiment of a hooded garment (or outerwear) of the present invention, generally depicted by the reference character 101. Components, which are unchanged from the first exemplary embodiment of the present invention, are labeled with the same reference characters. Components, which function in the same way as in the first exemplary embodiment of the present invention depicted in FIGS. 1 and 2 are designated by the same reference numerals to some of which number 100 has been added, sometimes without being described in detail since similarities between the corresponding parts in the two embodiments will be readily perceived by the reader.

The hooded garment 101 according to the sixth exemplary embodiment of the present embodiment is not limited to "pullover" garments (i.e., those without frontal closures such as buttons, zippers, hooks, hook/loop fasteners such as VELCRO®, and the like). Specifically, the hooded garment 101 according to the sixth exemplary embodiment of the present invention is a hooded jacket having a zipper 130.

The hooded jacket 101 includes a hood drawstring casing $\mathbf{110}_T$ (stitched at $\mathbf{110}_{CS}$) defining a hood drawstring channel $\mathbf{110}_C$ through which a drawstring 4 is guided. Adjacent a traditional zipper tape 31 (displaying zipper locking elements) of the zipper 130 are right and left torso drawstring casings $\mathbf{114}_{CR}$ and $\mathbf{114}_{CL}$, respectively, (stitched at $\mathbf{114}_{CS}$) defining right and left torso drawstring casings $\mathbf{114}_R$ and $\mathbf{114}_L$, respectively, through which the right and left side portions $\mathbf{4}_R$, $\mathbf{4}_L$ of drawstring 4 is guided. Also, guiding side portions $\mathbf{4}_R$, $\mathbf{4}_L$ of the drawstring 4 are guide rings or grommets $\mathbf{112}_R$, $\mathbf{112}_L$ and $\mathbf{116}_R$, $\mathbf{116}_L$, as disclosed hereinabove. The wearer's ready access to a drawstring lock 18 (not shown in FIG. 22, but as disclosed hereinabove), via a pocket 122 defined in part by stitching $\mathbf{122}_S$, provides a control of the tautness of the drawstring 4 required for closing a facial hood opening 109. It should be evident that the hooded jacket 101 illustrated in FIG. 22 has a left chest portion 102*al* is in generally closed position, while a right chest portion 102*ar* thereof is laid open to reveal internal details.

The torso portion 102 of the hooded garment 101 has an outer surface $\mathbf{102}_{OS}$ and an inner surface $\mathbf{102}_{IS}$. As illustrated in FIG. 22, the right and left torso drawstring casings $\mathbf{114}_{CR}$ and $\mathbf{114}_{CL}$ are provided on the inner surface $\mathbf{102}_{IS}$ of the hooded garment 101. The torso portion 102 of the hooded garment 101 according to the sixth exemplary embodiment of the present invention depicted in FIG. 22, further comprises hidden pockets 120. The hidden pockets 120 are provided (as for example by stitching or otherwise affixed) for storage of the distal ends [$\mathbf{4}_T$] of the drawstring 4 when secured (tied, locked, and the like).

Therefore, the present invention provides a novel hooded garment for a person. The hooded garment of the present invention provides a drawstring, which remains hidden within a body of the hooded garment as it is drawn through casing channels and exits into a storage pocket or other practical, accessible location. The hooded garment of the present invention effectively eliminates the threat of an otherwise exposed drawstrings being dangerously snagged or caught-up by external physical interference; thus ensuring a safer wearer.

It should be understood that, while the hooded garment according to the exemplary embodiments of the present invention, shown and described in detail hereinabove, is illustrated as a single marketable product, a retrofitting kit for pre-existing garments of the hooded type including the inventive concept of the present invention is within the scope of the present invention. In other words, the disclosure is intended to cover a separately marketable retrofit kit for application to pre-existing hooded garments. Such a kit would of course include (but not necessarily limited to) insertable guide casings, rings, locks, replacement drawstrings (as required) to be adapted to pre-existing garments. This would enable a consumer to preserve a favorite but outdated/unsafe garment by retrofitting it with a safer, more stylish drawstring control system.

The foregoing description of the preferred embodiment of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A hooded garment for a person, comprising:

a torso portion;

a hood portion attached to said torso portion and provided with a frontal face opening therein, said hood portion having a peripheral edge around said face opening and a hood drawstring channel extending around at least a greater part of said peripheral edge; and a flexible drawstring provided to adjust the effective perimeter of said peripheral edge of said face opening of said hood portion defining a size of said face opening, said flexible drawstring slidably extending through said hood channel;

wherein said drawstring includes a middle portion slidably disposed in said hood channel, a first side portion extending from one side of said hood channel and a second side portion extending from another side of said hood channel, wherein said first and second side portions are disposed outside said hood channel in said hood portion so that a greater part of each of said first and second side portions being hidden within or behind said torso portion, wherein said hood portion comprises a tunnel-like hood drawstring casing about said face opening defining said enclosed hood drawstring channel, and wherein said torso portion includes a pair of torso drawstring casings defining a pair of torso drawstring channels for each of said drawstring side portions.

2. The hooded garment as defined in claim 1, wherein said torso portion includes two arm portions integrally attached to said torso portion.

3. The hooded garment as defined in claim 1, wherein each of said first and second side portions of said drawstring is disposed behind an outer surface of said torso portion.

4. The hooded garment as defined in claim 1, further comprising a shiftable drawstring lock adjustably mounted to said drawstring, said drawstring and said drawstring lock cooperating to adjust the effective perimeter of said frontal face opening of said hood portion.

5. The hooded garment as defined in claim 1, wherein said peripheral edge of said hood portion is hemmed so as to form said hood drawstring casing.

6. The hooded garment as defined in claim 1, wherein said torso portion further includes a pocket muff, and wherein said side portions of the drawstring exit into the pocket muff.

7. The hooded garment as defined in claim 1, further comprising at least one upper guide ring receiving at least one of said side portions of said drawstring therethrough.

8. The hooded garment as defined in claim 7, wherein said at least one upper guide ring includes a plastic or metal grommet element.

9. The hooded garment as defined in claim 1, wherein each of said torso drawstring channels is provided with an upper guide ring at a proximal end thereof.

10. The hooded garment as defined in claim 9, wherein each of said torso drawstring channels is provided with a lower guide ring at a distal end thereof.

* * * * *